US006448940B1

(12) United States Patent
Chiang

(10) Patent No.: US 6,448,940 B1
(45) Date of Patent: Sep. 10, 2002

(54) TRIPLE REFLECTOR ANTENNA DEPLOYMENT AND STORAGE SYSTEMS

(75) Inventor: Jason J. Chiang, Fremont, CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 09/812,298

(22) Filed: Mar. 20, 2001

(51) Int. Cl.[7] ..... H01Q 3/02

(52) U.S. Cl. ..... 343/882; 343/DIG. 2; 244/165

(58) Field of Search ..... 343/DIG. 2, 878, 343/880, 881, 882, 912, 915; 244/164, 165, 173; H01Q 1/12, 1/28, 3/02

(56) References Cited

U.S. PATENT DOCUMENTS 5,597,142 A * 1/1997 Leung et al. ..... 244/164
5,673,057 A * 9/1997 Toland et al. ..... 343/761
5,835,057 A * 11/1998 Heyningen ..... 342/359
6,113,033 A * 9/2000 Parks et al. ..... 244/165
6,119,986 A * 9/2000 Stribling ..... 244/173
6,260,805 B1 * 7/2001 Yocum et al. ..... 244/164

* cited by examiner

*Primary Examiner*—Tho Phan
(74) *Attorney, Agent, or Firm*—Kenneth W. Float

(57) ABSTRACT

An antenna deployment system for use in storing and deploying three antennas that are located on the same side of a spacecraft or other fixed body. The three antennas are nested and are stacked in a stowed condition and are individually and sequentially deployed to their respective deployed positions. One or more feed horns are attached to the spacecraft or fixed body that illuminate the respective antennas. A dual axis deployment mechanism is used to deploy each antenna. The dual axis deployment mechanism is also used to steer the beam produced by the antenna. The dual axis deployment mechanism comprises a dual-axis rotatable hinge structure affixed to the spacecraft or fixed body that is coupled to the antenna by way of a substantially rigid reflector support structure. The dual axis deployment mechanism is actuated and controlled to deploy the antenna and steer the antenna beam.

6 Claims, 6 Drawing Sheets

TRIPLE REFLECTOR ANTENNA DEPLOYMENT AND STORAGE SYSTEMS

BACKGROUND

The present invention relates generally to spacecraft, and more particularly, to a three-antenna storage and deployment system for use on a spacecraft.

The assignee of the present invention manufactures and deploys communication spacecraft. Such spacecraft have antennas stowed thereon that are deployed once the spacecraft is in orbit. The antennas are used for communication purposes.

A number of deployable antennas have been developed in the past. Many of these antennas are used in ground-based vehicular applications. For instance, the Winegard Company has patented a variety of deployable antennas that are primarily designed for use on recreational vehicles, and the like. These patents include U.S. Pat. Nos. 5,554,998, 5,528,250, 5,515,065, 5,418,542, 5,337,062, and 4,771,293. The antennas disclosed in these patents have a single main reflector that illuminates a feed horn. These antennas are primarily designed to receive television signals broadcast from a satellite.

U.S. Pat. No. 4,771,293 entitled "Dual Reflector folding Antenna" discloses a folding antenna for use in a satellite communication system that is used as part of a mobile earth station that is part of a satellite communication system for news gathering purposes. This antenna has a supporting base, a main reflector and a subreflector. The main reflector and subreflector rotate downward toward the base from a deployed position to a stowed position where the two reflectors lie relatively close to the base. The base forms part of a container that encloses the reflectors when in the stowed position. The two reflectors are hinged relative to each other and relative to the base. The two reflectors move from a stowed position where they lie relatively close to the base, to a deployed position where they are relatively spaced from the base.

U.S. Pat. No. 5,554,998 entitled "Deployable satellite antenna for use on vehicles" is typical of the other cited patents and discloses a deployable satellite antenna system that is intended for mounting on the roof of a vehicle. The elevational position of the reflector is controlled by a reflector support having a lower portion pivotably attached to a base mounted to the vehicle. The elevational position of the reflector can be adjusted between a stowed position in which the reflector is stored face-up adjacent to the vehicle and a deployed position. The feed horn is supported at the distal end of a feed arm having a first segment attached to the reflector support extending outward between the base and reflector, and a second segment pivotably connected to the distal end of the first segment. The feed horn segments move between an extended position in which the feed horn is positioned to receive signals reflected from the reflector, and a folded position in which the feed horn is positioned adjacent to the reflector. A linkage extends between the base and the second segment of the feed arm causing the second segment of the feed arm to automatically pivot to its folded position when the reflector is moved to its stowed position. The linkage also allows a spring to pivot the second segment to its extended position when the reflector is moved to its deployed position. The azimuth of the antenna can be controlled by rotating the base relative to the roof of the vehicle.

The other cited patents generally relate to deployable satellite antennas that have all the major antenna components (i.e. feed horn assembly, subreflector, main reflector) move independently to deploy and stow the antenna. These other patents are generally unrelated to the present invention.

None of the above-cited antennas are particularly well-suited for use on a spacecraft. Single reflector antennas are typically not used in spacecraft communication systems. The dual reflector antennas disclosed in U.S. Pat. No. 4.771,293, as well as the other antennas, have many moving parts and would therefore be relatively unreliable when used in space applications.

U.S. patent application Ser. No. 69/663,544, filed Sep. 15/2000, entitled "Main Reflector and Subreflector Deployment and Stowage Systems" assigned to the assignee of the present invention discloses improved systems that are used to store and deploy an antenna disposed on a spacecraft. The antenna comprises an RF teed horn assembly, a main reflector assembly and a subreflector. Alternative embodiments of this invention package one or two antenna systems each having an RF feed horn assembly, a main reflector assembly and a subreflector.

Heretofore, there have been no systems that are used to store and deploy three reflector antennas that are located on the same side of a spacecraft. It would be desirable to have a system that has the ability to store and deploy three antennas on the same side of a spacecraft. Therefore, it is an objective of the present invention to provide for a three-antenna storage and deployment system for use on a spacecraft.

SUMMARY OF THE INVENTION

To accomplish the above and other objectives, the present invention provides for an improved antenna deployment system that is used to store and deploy three reflector antennas that are located on the same side of a spacecraft. The three antennas are nested and are stacked in a stowed condition and are individually and sequentially deployed into their respective deployed positions. One or more feed horns are attached to the spacecraft that illuminate the respective antennas.

One dual axis deployment mechanism is used to deploy each antenna. The respective dual axis deployment mechanisms are used to both deploy the antenna and steer the beam produced by the antenna (beam steering). The dual axis deployment mechanism comprises a dual-axis rotatable hinge structure affixed to the spacecraft that is coupled to the antenna by way of a substantially rigid reflector support structure. The dual axis deployment mechanism is actuated and controlled to deploy the antenna and steer the antenna beam.

The substantially rigid reflector support structure is attached to a first portion of the dual-axis rotatable hinge structure that rotates about a first axis. The second portion of the dual-axis rotatable hinge structure is coupled to the spacecraft and rotates about a second axis. This provides for dual-axis rotation of the deployed antenna.

Each antenna is disposed in a fixed relation relative to the one or more feed horns when the antenna is in the deployed position so that it generates a predetermined beam coverage pattern. The predetermined beam coverage pattern is steerable by actuating the dual-axis rotatable hinge structure to rotate the antenna about either of the axes.

The present invention provides compact packaging of three antennas, and thus provides for an antenna system having a compact stowage volume. The present invention stows and deploys the three antennas as a single unit.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DETAILED DESCRIPTION

Figure 1:
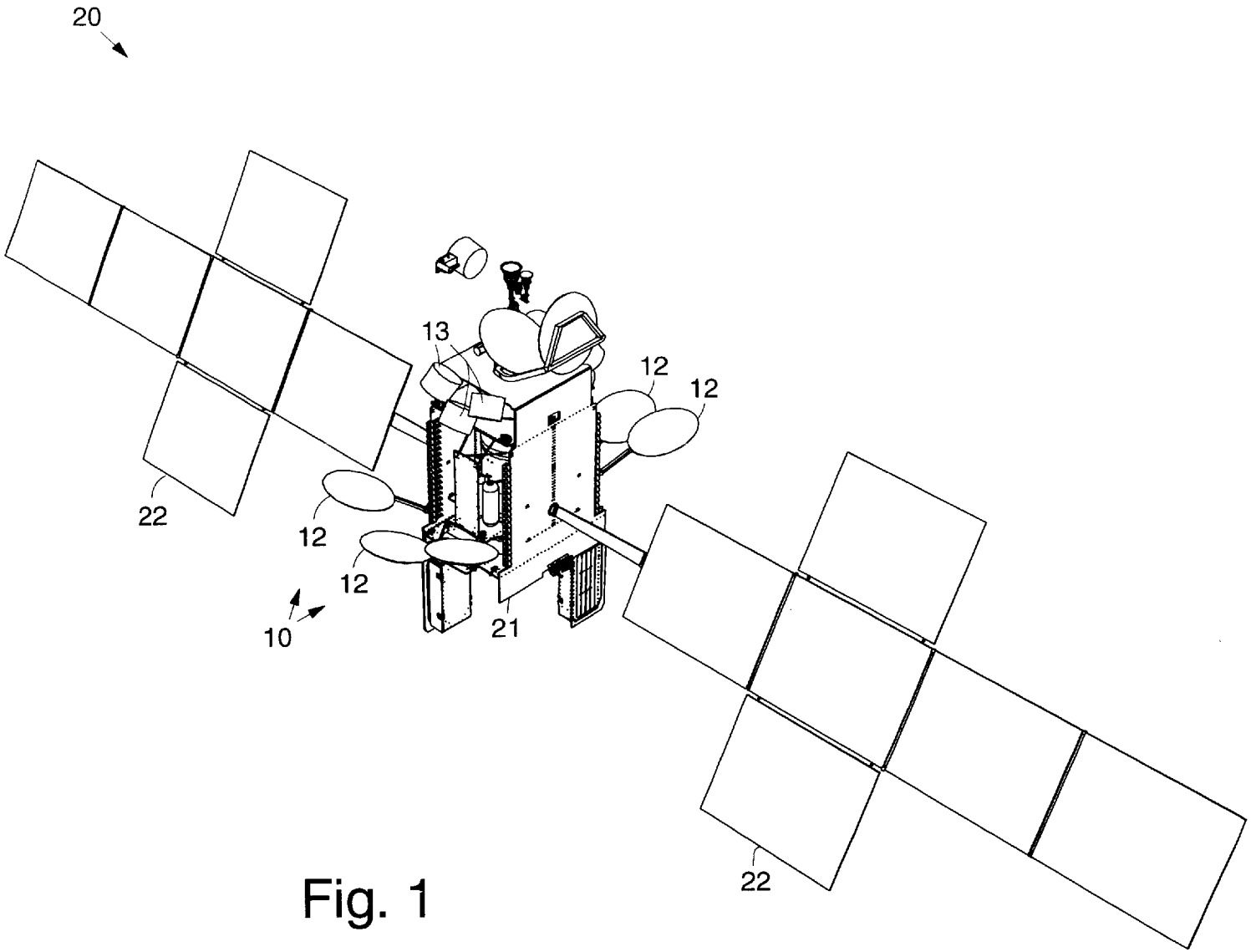
FIG. 1 illustrates an exemplary spacecraft employing exemplary three antenna stowage and deployment systems in accordance with the principles of the present invention.

Referring to the drawing figures, FIG. 1 illustrates an exemplary spacecraft 20 employing exemplary three antenna stowage and deployment systems 10 in accordance with the principles of the present invention. The spacecraft 20 has a body 21 to which a plurality of solar arrays 22 are attached. FIG. 1 shows that the spacecraft 20 has two antenna stowage and deployment systems 10 disposed on opposite sides (North and South facing sides) thereof.

Figure 2A:
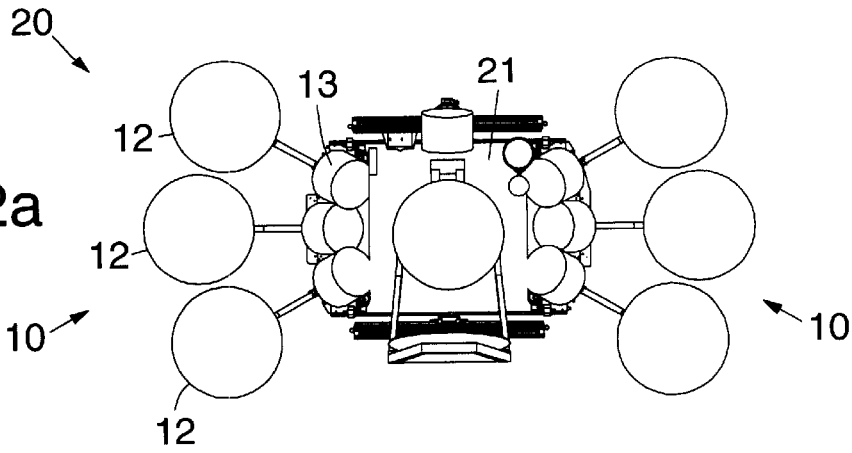
FIGS. 2*a*–2*c* illustrate top, side and end views, respectively, of an exemplary three antenna stowage and deployment system in accordance with the principles of the present invention for use on a spacecraft that is shown in a deployed configuration.
Figure 2B:
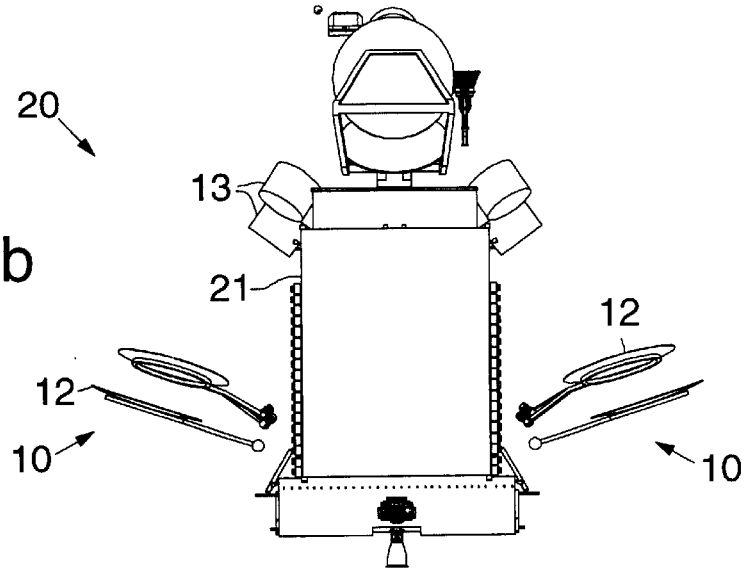
Figure 2C:
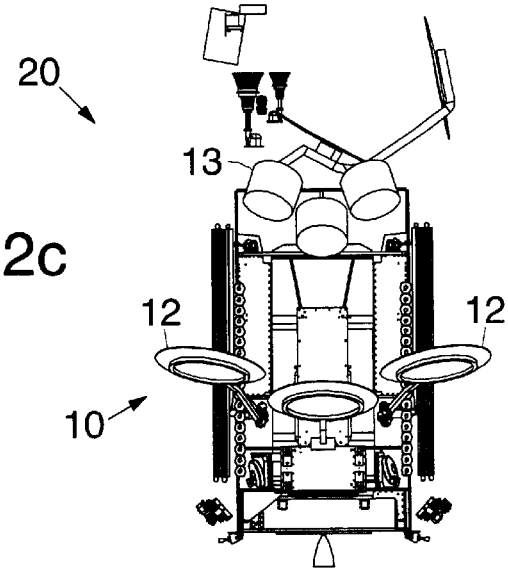

FIGS. 2*a*–2*c* illustrate top, side and end views, respectively, of the spacecraft 20 shown in FIG. 1. The spacecraft 20 uses two three-antenna stowage and deployment systems 10. The respective systems 10 each used to store and deploy three antennas 12, such as reflector antennas 12, for example.

Figure 3A:
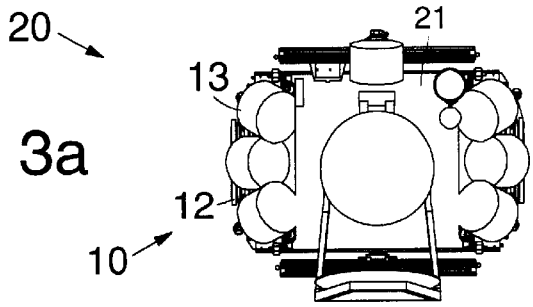
FIGS. 3*a*–3*c* illustrate top, side and end views, respectively, of the spacecraft stowage and deployment system shown in a stowed configuration.
Figure 3B:
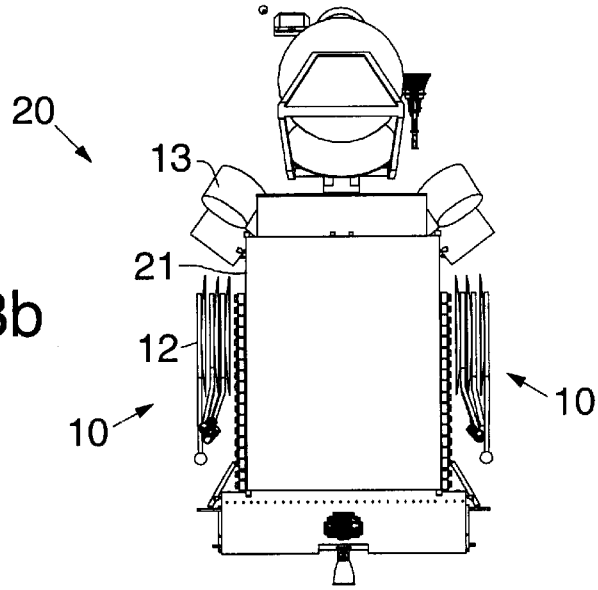
Figure 3C:
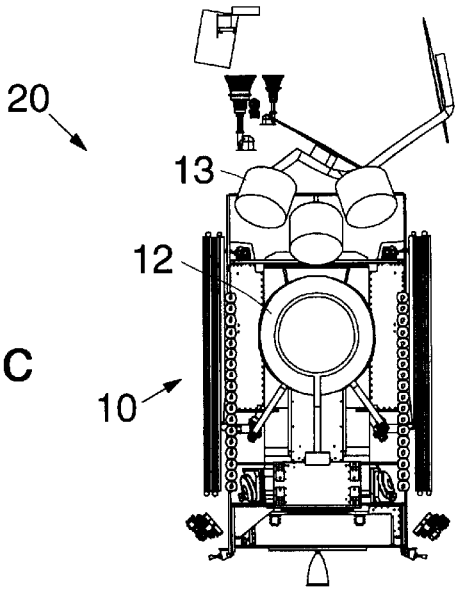

In the system 10 shown in FIGS. 3*a*–3*c*, the three antennas are in stowed positions. The three antennas 12 are each moveable from the stowed positions to deployed positions. FIGS. 2*a*–2*c* illustrate top, side and end views, respectively, of the spacecraft stowage and deployment system 10 with the three antennas 12 in their deployed positions.

In the embodiments shown in certain of the drawing figures, such as FIG. 1, FIGS. 2*a*–2*c* and FIGS. 3*a*–3*c*, certain structural elements are not shown, particularly with regard to structures that attach the systems 10 and certain other components to the body 21 of the spacecraft 20. It thus appears that the antennas 12 are not attached to the spacecraft 20 in FIGS. 2*b* and 3*b*, while in actuality they are. The support structures are shown more clearly in certain of FIGS. 4–9.

The respective antennas 12 are each employed with a corresponding feed horn assembly 13. Three feed horn assemblies 13 are disposed adjacent a top portion of the body 21 of the spacecraft 20. The three feed horn assemblies 13 are disposed at a fixed angle relative to the location of the respective deployed antennas 12.

Details of an exemplary three antenna stowage and deployment system 10 shall be discussed with reference to FIGS. 4–10. FIGS. 4–9 illustrate an exemplary deployment sequence used to sequentially deploy the respective antennas 12 of the three antenna stowage and deployment system 10 such as is shown in FIGS. 2*a*–2*c* and 3*a*–3*c*. The arrows shown in FIGS. 4–9 illustrate movement of the respective antenna 12 from its stowed position to its deployed position.

Figure 4:
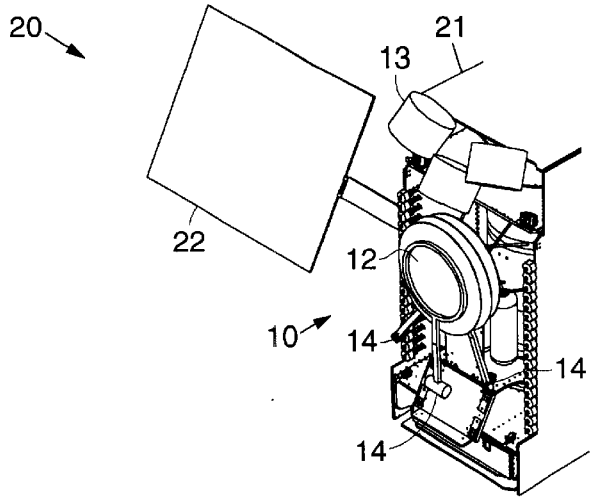
FIGS. 4–9 show enlarged views of a portion of the spacecraft illustrating the deployment sequence used to deploy the three antennas shown in FIGS. 3*a*–3*c* to produce the deployed configuration shown in FIGS. 2*a*–2*c*.
Figure 5:
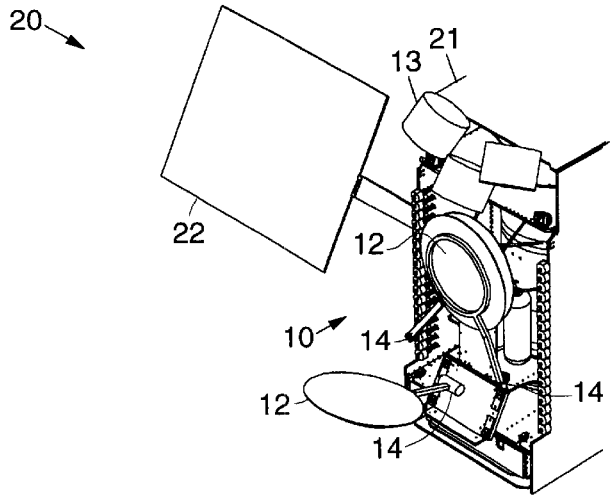

FIG. 4 shows the initial stowed configuration of the three antenna stowage and deployment system 10. The three antennas 12 are stacked on top of each other, as is shown in FIG. 3*b*. In the exemplary embodiment, the center antenna 12 is first deployed as is shown in FIG. 5. The center antenna 12 is rotated downward into its deployed position, exposing the second antenna 12, which is referred to as a first corner antenna 12.

Figure 6:
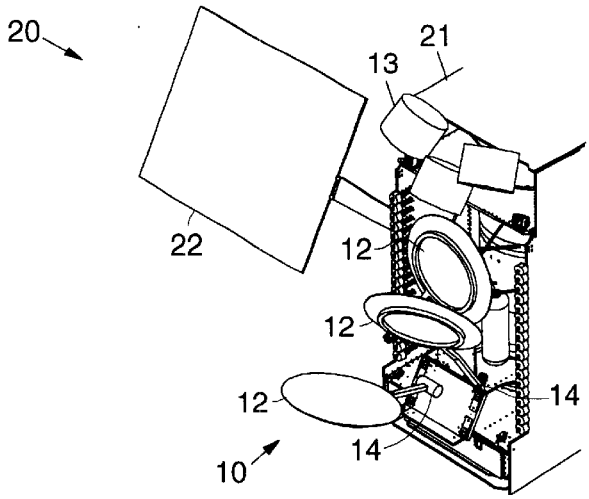
Figure 7:
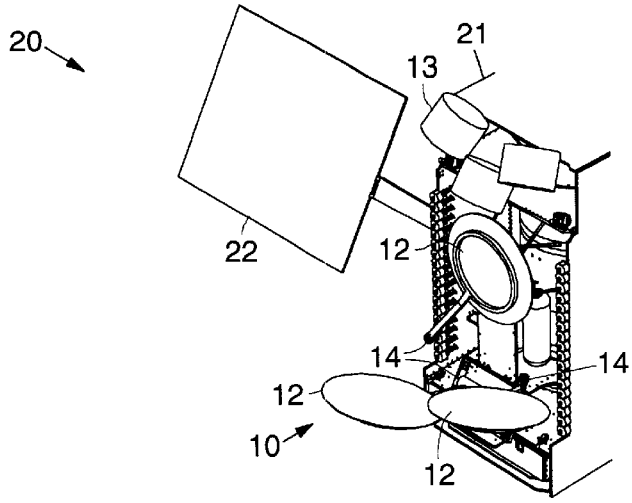

FIG. 6 illustrates partial deployment of the first corner antenna 12. In FIG. 6, the first corner antenna 12 has been rotated about half way to its deployed position. FIG. 7 illustrates the first corner antenna 12 in its fully deployed position. This exposes the third antenna 12, which is referred to as a second corner antenna 12.

Figure 8:
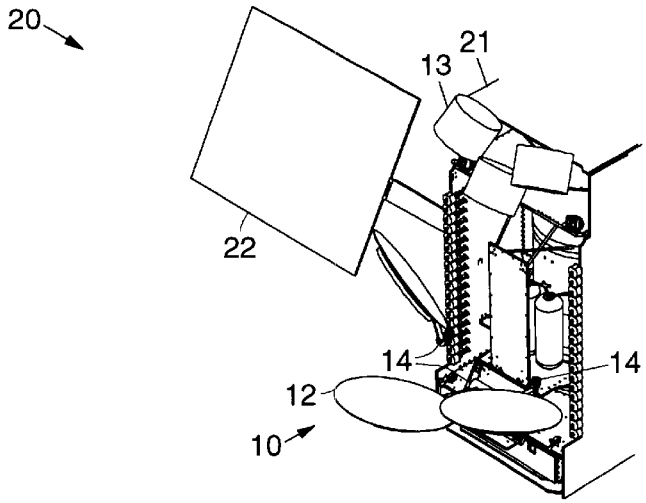
Figure 9:
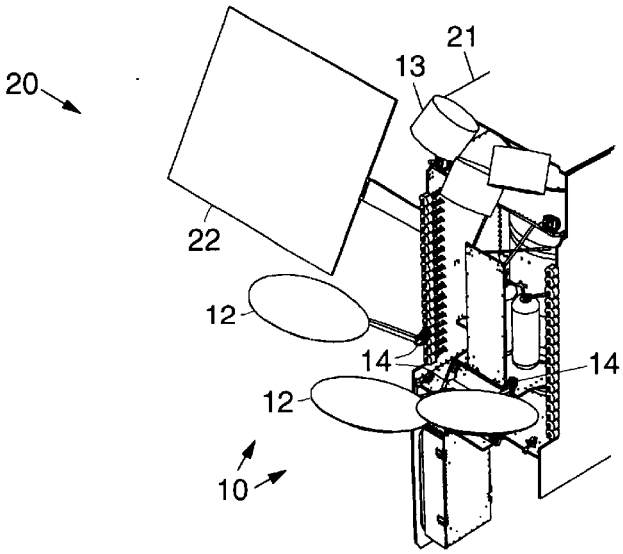

FIG. 8 illustrates partial deployment of the second corner antenna 12. In FIG. 8, the second corner antenna 12 has been rotated about one-third of the way to its deployed position. FIG. 9 illustrates the second corner antenna 12 in its fully deployed position. All three antennas 12 are now in their fully deployed positions.

Figure 10:
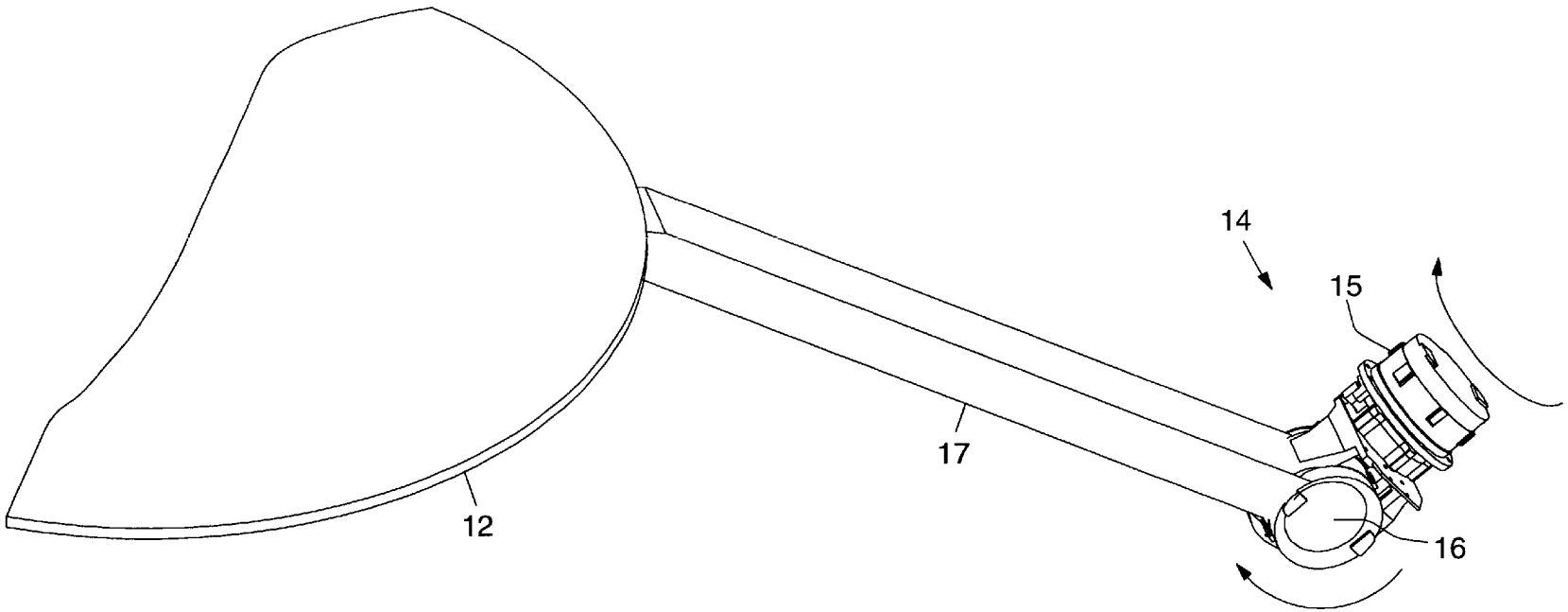
FIG. 10 is an enlarged view showing an exemplary dual-axis rotatable hinge structure that may be used in the present invention.

FIG. 10 is an enlarged view showing an exemplary dual-axis rotatable hinge structure 14 that may be used in the exemplary three antenna stowage and deployment system 10. The exemplary dual-axis rotatable hinge structure 14 is coupled to the antenna 12 by means of a structural member 17, such as a beam 17 or tubular member 17.

The exemplary dual-axis rotatable hinge structure 14 is comprised of two rotatable joints 15, 16, which are respectively rotatable about two orthogonal axes so that the antenna 12 may be,deployed (rotated downward) from its stowed position to its deployed position, and also rotated about both the first and second orthogonal axes to facilitate beam pointing. The two curved arrows shown in FIG. 10 illustrate the directions that the antenna 12 may be moved about the two rotational axes.

Thus, three antenna stowage and deployment systems for use on a spacecraft have been disclosed. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. A three antenna stowage and deployment system for use on a fixed body, comprising:

one or more feed horn assemblies fixedly attached to one side of the fixed body;

three rotatable hinge structures attached to the one side of the fixed body;

three antennas respectively coupled to the three rotatable hinge structures that are rotatable from a stowed position to a deployed position so that the three antennas each generate a predetermined beam coverage pattern.

2. The system recited in claim 1 wherein the rotatable hinge structures are rotatable about two orthogonal axes.

3. The system recited in claim 1 wherein the rotatable hinge structures comprises two rotatable joints.

4. The system recited in claim 1 wherein the rotatable hinge structures are rotatable about two orthogonal axes so that the antennas may be deployed from their stowed positions to their deployed positions, and also rotated about both the first and second orthogonal axes to facilitate controllable beam pointing.

5. The system recited in claim 1 wherein the fixed body comprises a spacecraft.

6. The system recited in claim 1 wherein one feed horn assembly is operatively coupled to a corresponding one of the three antennas.

* * * * *